US009310821B2

(12) United States Patent
Buiatti

(10) Patent No.: US 9,310,821 B2
(45) Date of Patent: Apr. 12, 2016

(54) METHOD FOR OBTAINING INFORMATION ENABLING THE DETERMINATION OF A CHARACTERISTIC OF A POWER SOURCE

(75) Inventor: Gustavo Buiatti, Rennes (FR)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 390 days.

(21) Appl. No.: 13/515,523

(22) PCT Filed: Dec. 8, 2010

(86) PCT No.: PCT/EP2010/069210
§ 371 (c)(1),
(2), (4) Date: Jun. 13, 2012

(87) PCT Pub. No.: WO2011/073069
PCT Pub. Date: Jun. 23, 2011

(65) Prior Publication Data

US 2012/0249167 A1 Oct. 4, 2012

(30) Foreign Application Priority Data

Dec. 14, 2009 (EP) ..... 09179087

(51) Int. Cl.
*G05F 1/67* (2006.01)

(52) U.S. Cl.
CPC ..... *G05F 1/67* (2013.01)

(58) Field of Classification Search
None
See application file for complete search history.

(56) References Cited

U.S. PATENT DOCUMENTS

| | | | | |
|---|---|---|---|---|
| 5,381,327 | A * | 1/1995 | Yan | 363/24 |
| 5,869,956 | A | 2/1999 | Nagao et al. | |
| 5,932,994 | A * | 8/1999 | Jo et al. | 323/222 |
| 6,111,767 | A * | 8/2000 | Handleman | 363/95 |
| 6,339,538 | B1 | 1/2002 | Handleman | |
| 2006/0132102 | A1 | 6/2006 | Harvey | |
| 2009/0284240 | A1 | 11/2009 | Zhang et al. | |
| 2009/0289594 | A1 | 11/2009 | Sato | |
| 2010/0046250 | A1 * | 2/2010 | Noda | 363/16 |
| 2012/0139504 | A1 | 6/2012 | Buiatti | |

FOREIGN PATENT DOCUMENTS

EP 2 056 180 5/2009

OTHER PUBLICATIONS

U.S. Appl. No. 13/513,779, filed Jun. 4, 2012, Buiatti.
Hua, C., et al., "Comparative Study of Peak Power Tracking Techniques for Solar Storage System," Applied Power Electronics Conference and Exposition. vol. 2, pp. 679-685, (Feb. 15, 1998).
International Search Report Issued Mar. 10, 2011 in PCT/EP10/69210 Filed Dec. 8, 2010.

* cited by examiner

*Primary Examiner* — Melissa Koval
*Assistant Examiner* — Courtney McDonnough
(74) *Attorney, Agent, or Firm* — Oblon, McClelland, Maier & Neustadt, L.L.P.

(57) ABSTRACT

An apparatus for obtaining information enabling a characteristic like determination of maximum power point of a power source, the apparatus including at least an inductor and a capacitor, the information enabling the determination of the characteristic of the power source being obtained by monitoring the voltage charge of the capacitor, and a mechanism discharging the capacitor through the inductor prior to the monitoring of the charge of the capacitor.

10 Claims, 7 Drawing Sheets

METHOD FOR OBTAINING INFORMATION ENABLING THE DETERMINATION OF A CHARACTERISTIC OF A POWER SOURCE

The present invention relates generally to an apparatus and a method for obtaining information enabling the determination of a characteristic like the maximum power point of a power source like a photovoltaic cell or an array of cells or a fuel cell.

A photovoltaic cell directly converts solar energy into electrical energy. The electrical energy produced by the photovoltaic cell can be extracted over time and used in the form of electric power. The direct electric power provided by the photovoltaic cell is provided to conversion devices like DC-DC up/down converter circuits and/or DC/AC inverter circuits.

However, the current-voltage droop characteristics of photovoltaic cells cause the output power to change nonlinearly with the current drawn from photovoltaic cells. The power-voltage curve changes according to climatic variations like light radiation levels and operation temperatures.

The near optimal point at which to operate photovoltaic cells or arrays of cells is at or near the region of the current-voltage curve where power is greatest. This point is denominated as the Maximum Power Point (MPP).

It is important to operate the photovoltaic cells around the MPP to optimize their power generation efficiency.

As the power-voltage curve changes according to climatic variations, the MPP also changes according to climatic variations.

It is then necessary to be able to identify the MPP at any time.

The present invention aims at providing an apparatus which enables to obtain information representative of the output current and voltage variations of the power source, for example an array of photovoltaic cells, in order to determine its maximum power point.

To that end, the present invention concerns an apparatus for obtaining information enabling the determination of a characteristic like the maximum power point of a power source, the apparatus comprising at least an inductor and a capacitor, the information enabling the determination of the characteristic of the power source being obtained by monitoring the voltage charge of the capacitor, characterised in that the apparatus for obtaining information enabling the determination of the characteristic of the power source comprises means for discharging the capacitor through the inductor prior to the monitoring of the capacitor charge.

The present invention concerns also a method for obtaining information enabling the determination of a characteristic like the maximum power point of a power source connected to a direct current converter, the direct current converter comprising at least an inductor and a capacitor, characterised in that the method comprises the steps of:

discharging the capacitor through the inductor, monitoring the voltage charge of the capacitor in order to obtain information enabling the determination of the characteristic of the power source.

Thus, it is possible to obtain information representative of the output current and voltage variations of the power source, for example, in order to determine the MPP or to determine a fault of the power source or to determine a fill factor of the power source.

Furthermore, in most of DC/DC and/or DC/AC converters, the capacitor and the inductor are already available for conversion purpose. The capacitor and the inductor can be also used for monitoring the voltage and current variations during at least one particular period of time. The monitored voltage and current variations enable the obtaining of information like the wanted voltage-current/voltage-power droop characteristics of the power source at any time. The present invention avoids to add any other extra inductor or capacitor to the system.

According to a particular feature, the apparatus comprises means for monitoring the current flowing through the inductor during the discharge of the capacitor and the capacitor is discharged in the inductor as long as the current flowing through the inductor reaches a first predetermined current value or as long as the capacitor is not discharged.

Thus, it is possible to limit the current levels on both the inductor and capacitor, avoiding large current peaks due to the resonance between the inductor and the capacitor, which may cause the saturation of the inductor magnetic core and also decrease the lifetime of the capacitor.

According to a particular feature, the apparatus comprises means for discharging the inductor into at least another device once the current flowing through the inductor value reaches the first predetermined value or once the capacitor is discharged.

According to a particular feature, the other device is an energy storage device or a load.

Thus, the energy stored in the inductor is not dissipated in any resistive component but it is exchanged with other storage devices such as a capacitor or even directly supplied to the load, resulting in a non-dissipative procedure. There is no power interruption from the power source side, since during the inductor discharge the power source continues to store power into the input capacitor.

According to a particular feature, the apparatus comprises means for obtaining the current outputted by the power source during the monitoring of the charge of the capacitor.

Thus, it is possible to obtain the whole voltage-current/voltage-power droop characteristics of the power source from null voltage value up to the open-circuit voltage value.

According to a particular feature, the current outputted by the power source is obtained from a current sensor or derived from the voltage values obtained during the monitoring of the charge of the capacitor.

Thus, the implementation cost may not be increased if the current sensor is not available. Finally, no additional component is needed at all to implement this technique.

According to a particular feature, the discharge of the capacitor through the inductor and the discharge of the inductor are executed iteratively as far as the voltage of the capacitor reaches a second predetermined value.

Thus, the capacitor discharge can happen in a non dissipative way, meaning that the energy which was stored in the capacitor is completely given to the load, reducing the drawbacks of stopping the power source supply during this small period of time when this energy is dissipated in a resistor, for example.

The present invention concerns also a direct current converter characterised in that it comprises the apparatus for obtaining information enabling the determination of the maximum power point of a power source.

Thus, it is possible to obtain information representative of the output current and voltage variations of the power source, for example an array of photovoltaic cells, in order to determine the MPP.

Furthermore, in most of DC/DC and/or DC/AC converters, the capacitor and the inductor are already available for conversion purpose. The capacitor and the inductor can also be used for monitoring the voltage and current variations during at least one particular period of time. The monitored voltage and current variations enable the obtaining of information like the wanted voltage-current/voltage-power droop characteristics of the power source at any time. The present invention avoids to add any other extra inductor or capacitor to the system.

The characteristics of the invention will emerge more clearly from a reading of the following description of an example embodiment, the said description being produced with reference to the accompanying drawings, among which:

Figures 7A, 7B, 7C:
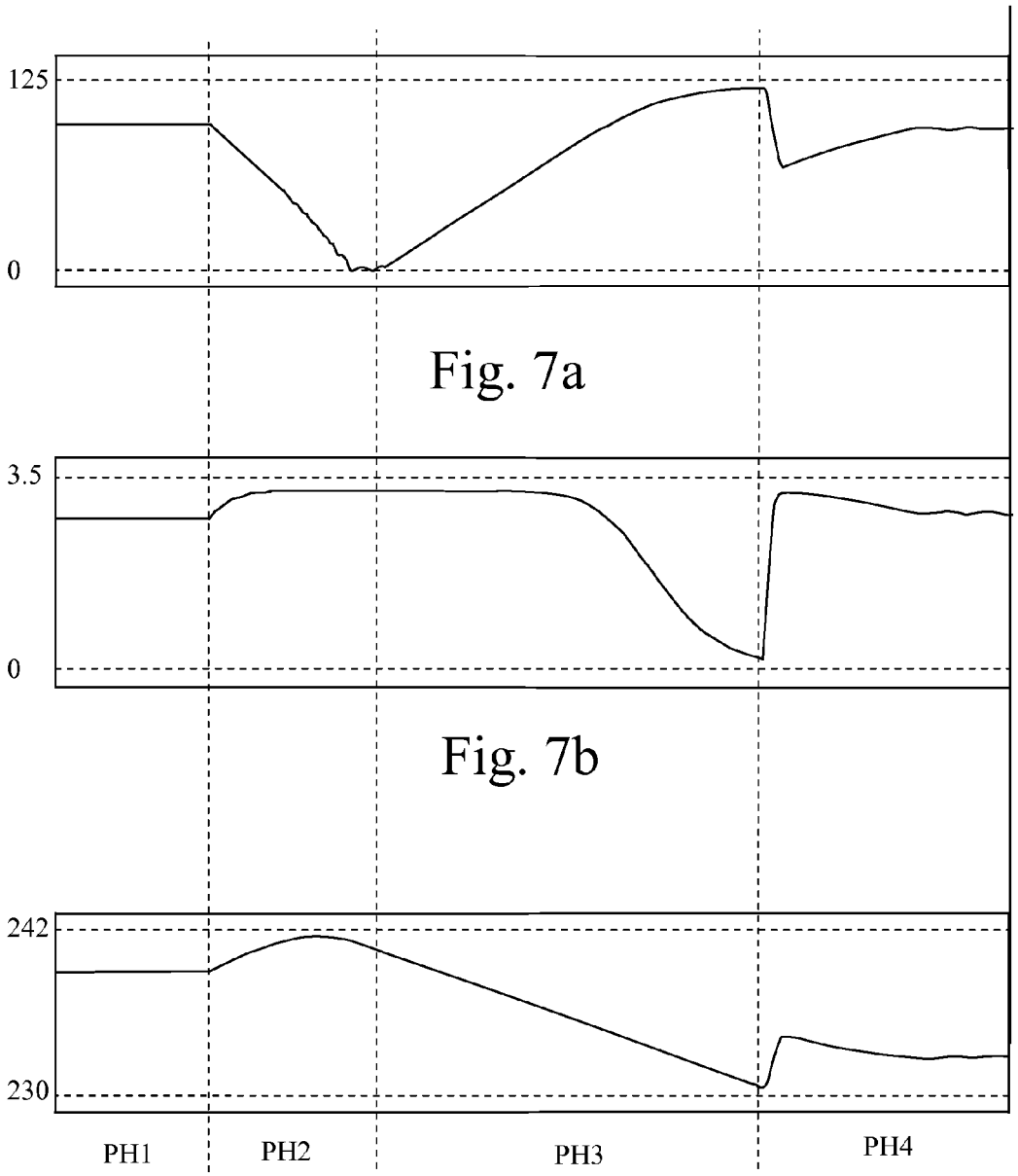
Figure 8A:
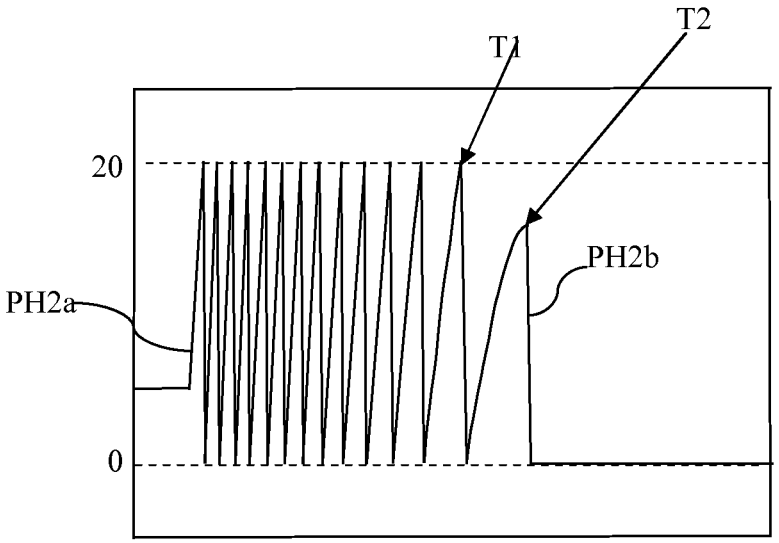
Figure 8B:
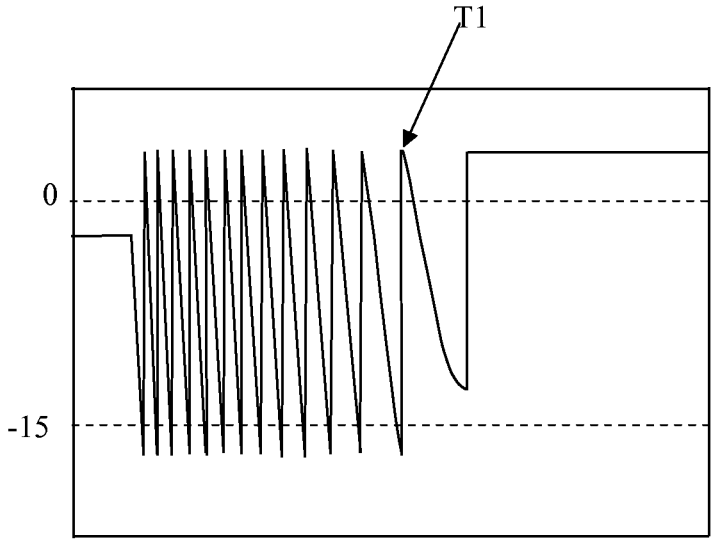
Figure 9:
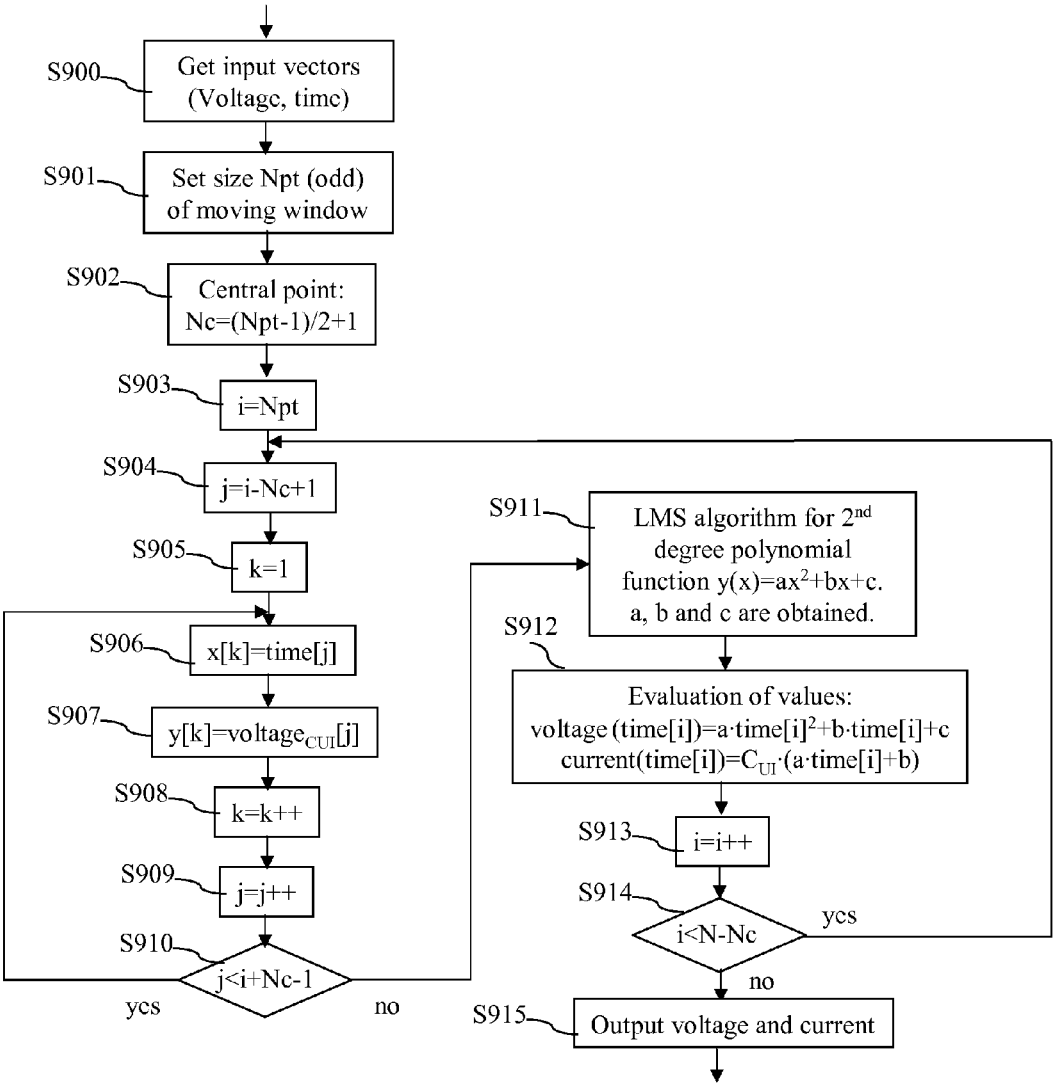

FIG. 7*a* is an example of the power source voltage variations obtained according to the present invention;

FIG. 7*b* is an example of power source current variations obtained according to the present invention;

FIG. 7*c* is an example of the output voltage variations of the energy conversion device according to the present invention;

FIG. 8*a* is an example of variations of the current flowing through the inductor during the capacitor discharging phase, which is composed of several interleaved sub-phases of partial charges and discharges, according to the present invention;

FIG. 8*b* is an example of variations of the current flowing through the capacitor during the capacitor discharging phase, which is composed of several interleaved sub-phases of partial charges and discharges, according to the present invention;

FIG. 9 is an example of an algorithm for determining the output current and output voltage pairs of the power source in order to enable the determination of the maximum power point of the power source according to the mode of realisation of the present invention.

Figure 1:
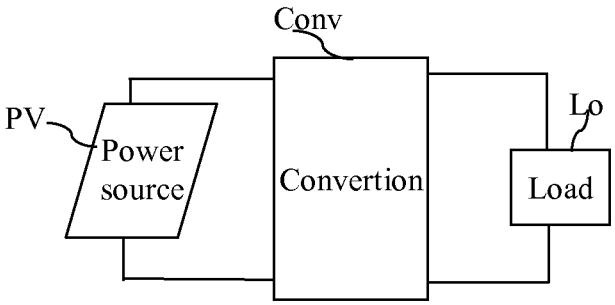
FIG. 1 is an example of an energy conversion system wherein the present invention may be implemented.

FIG. 1 is an example of an energy conversion system wherein the present invention may be implemented.

The energy conversion system is composed of a power source PV like a photovoltaic cell or an array of cells or a fuel cell connected to an energy conversion device Conv like a DC-DC step-down/step-up converter and/or a DC/AC converter also named inverter, which output provides electrical energy to the load Lo.

The power source PV provides current intended to the load Lo. The current is converted by the conversion device Conv prior to be used by the load Lo.

Figure 2:
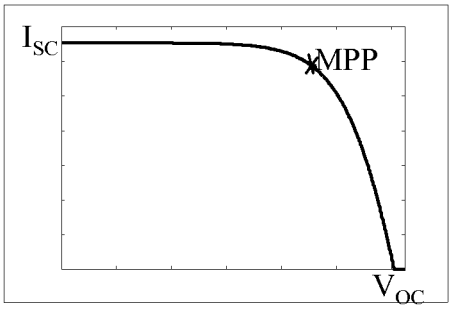
FIG. 2 is an example of a curve representing the output current variations of a power source according to the output voltage of the power source.

FIG. 2 is an example of a curve representing the output current variations of a power source according to the output voltage of the power source.

On the horizontal axis of FIG. 2, voltage values are shown. The voltage values are comprised between null value and the open circuit voltage $V_{OC}$.

On the vertical axis of FIG. 2, current values are shown. The current values are comprised between null value and the short circuit current $I_{SC}$.

At any given light level and photovoltaic array temperature there is an infinite number of current-voltage pairs, or operating points, at which the photovoltaic array can operate. However, there exists a single MPP for a given light level and photovoltaic array temperature.

Figure 3:
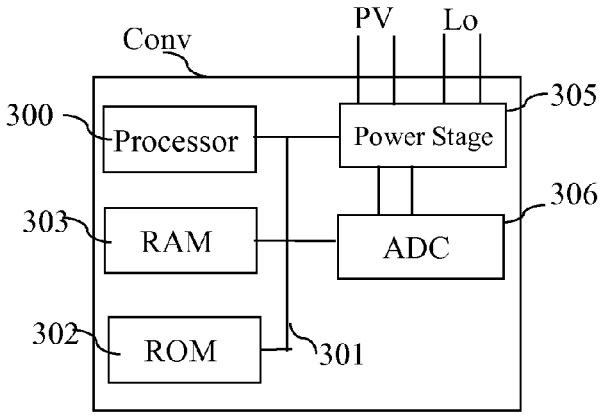
FIG. 3 represents an example of a device comprising an energy conversion device according to the present invention.

FIG. 3 represents an example of a device comprising an energy conversion device according to the present invention.

Figure 6:
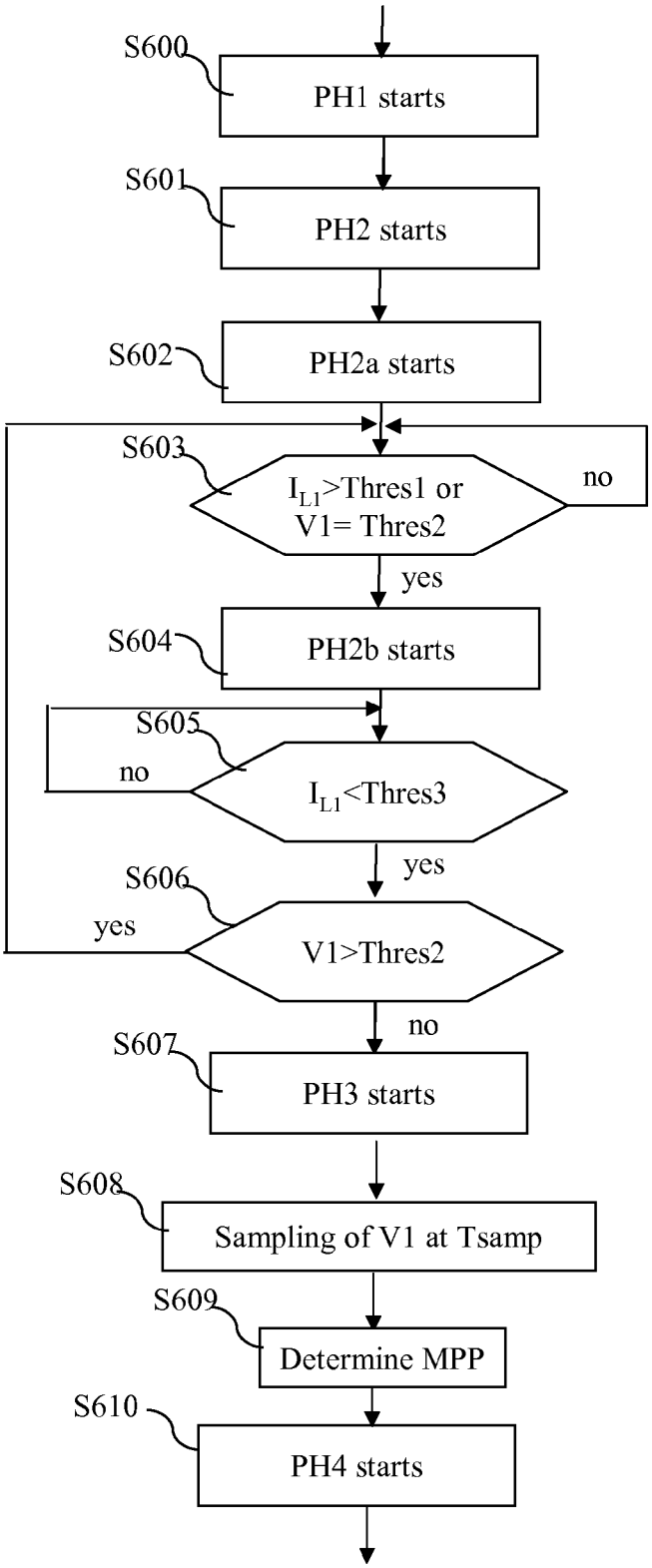
FIG. 6 is an example of an algorithm for determining the maximum power point of the power source according to the present invention.

The energy conversion device Conv has, for example, an architecture based on components connected together by a bus 301 and a processor 300 controlled by the programs related to the algorithms as disclosed in the FIGS. 6 and 9.

It has to be noted here that the energy conversion device Conv is, in a variant, implemented under the form of one or several dedicated integrated circuits which execute the same operations as the one executed by the processor 300 as disclosed hereinafter.

The bus 301 links the processor 300 to a read only memory ROM 302, a random access memory RAM 303, an analogue to digital converter ADC 306 and the electric circuit 305 according to the invention.

The read only memory ROM 302 contains instructions of the programs related to the algorithms as disclosed in the FIGS. 6 and 9 which are transferred, when the energy conversion device Conv is powered on to the random access memory RAM 303.

The RAM memory 303 contains registers intended to receive variables, and the instructions of the programs related to the algorithms as disclosed in the FIGS. 6 and 9.

The analogue to digital converter 306 is connected to the electric circuit 305 according to the invention which forms the power stage and converts voltages and currents if needed into binary information.

Figure 4:
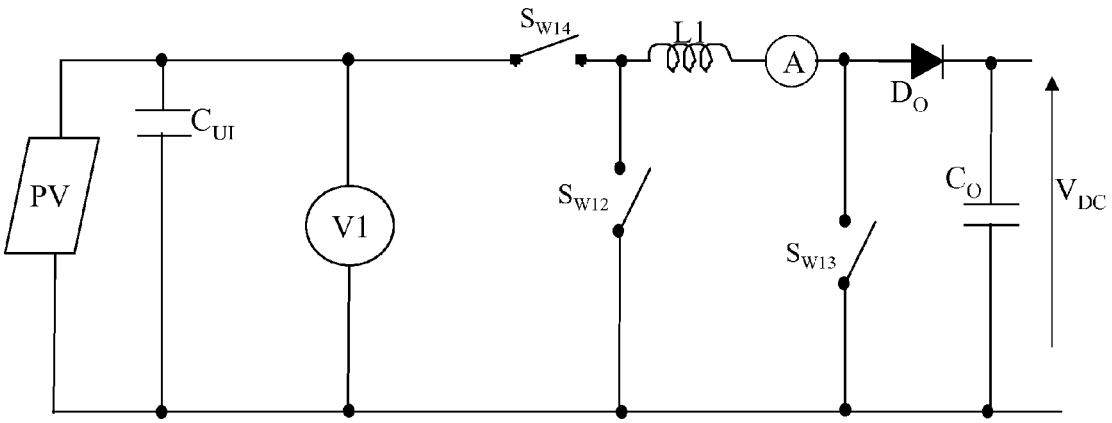
FIG. 4 is an example of an energy conversion device comprising an inductor and a capacitor according to the present invention in order to obtain information enabling the determination of the maximum power point of the power source.

FIG. 4 is an example of an electric circuit comprising an inductor and a capacitor according to the present invention in order to obtain information enabling the determination of the maximum power point of the power source.

The electric circuit is a merged buck/boost converter which is able, according to the state of switches, to operate in a buck mode (step-down mode) or in a boost mode (step-up mode), without inverting the output voltage polarity as it is done with the classical buck-boost converter.

The electric circuit according to the present invention comprises an input filter capacitor $C_{UI}$, the positive terminal of which is connected to the positive terminal of the power source PV. The negative terminal of the capacitor $C_{UI}$ is connected to the negative terminal of the power source PV. Voltage measurement means measure the voltage V1 on the capacitor $C_{UI}$ and on inductor L1 when the latter one is connected in parallel with the power source.

The positive terminal of the capacitor $C_{UI}$ is connected to a first terminal of a switch $S_{W14}$.

The second terminal of switch $S_{W14}$ is connected to a first terminal of a switch $S_{W12}$ and to a first terminal of an inductor L1.

The second terminal of a switch $S_{W12}$ is connected to the negative terminal of the power source PV.

The second terminal of the inductor L1 is connected to a first terminal of current measurement means.

The second terminal of current measurement means A is connected to the anode of a diode $D_O$ and to a first terminal of a switch $S_{W13}$. The second terminal of the switch $S_{W13}$ is connected to the negative terminal of the power source PV.

The cathode of the diode $D_O$ is connected to the positive terminal of a capacitor $C_O$ and the negative terminal of the capacitor $C_O$ is connected to the negative terminal of the power source PV.

When the merged buck/boost converter operates in buck mode, the switch $S_{W13}$ is always in OFF state and diode $D_O$ is always in conductive state.

The switch $S_{W14}$ is put in a conductive state according to a periodic pattern of which the duty cycle is adjusted in order to get a desired output voltage $V_{DC}$. The period of time the switch $S_{W14}$ is high is named D. The period of time wherein the command signal of the switch $S_{W14}$ is low is named (1−D).

The switch $S_{W12}$ is in non conductive state during D and is in conductive state during (1−D).

When the merged buck/boost converter operates in boost mode, the switch $S_{W14}$ is always in conductive state and the switch $S_{W12}$ is never in conductive state.

The switch $S_{W13}$ is in conductive state during D and is in non conductive state during (1−D).

Figure 5:
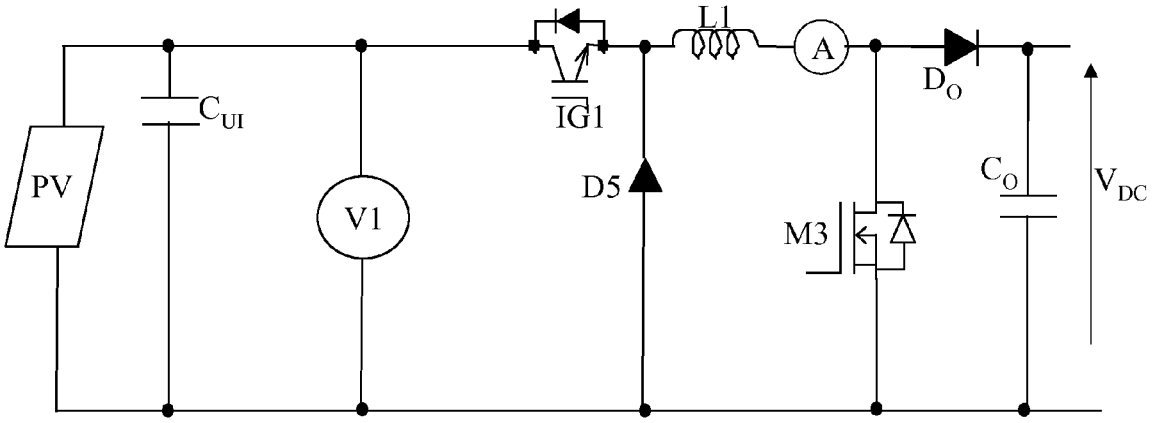
FIG. 5 is an example disclosing a particular mode of realisation of the switches of the electric circuit according to the present invention.

FIG. 5 is an example disclosing a particular mode of realisation of the switches of the electric circuit according to the present invention.

The switch $S_{W14}$ of FIG. 5 is for example an IGBT transistor IG1. The first terminal of the switch $S_{W14}$ is the collector of the IGBT transistor IG1.

The emitter of the IGBT transistor IG1 is the second terminal of the switch $S_{W14}$.

The switch $S_{W12}$ of FIG. 5 is a diode D5. The first terminal of the switch $S_{W12}$ is the cathode of the diode D5 and the second terminal of the switch $S_{W12}$ is the anode of the diode D5.

The switch $S_{W13}$ of FIG. 5 is a NMOSFET M3. The first terminal of the switch $S_{W13}$ is the drain of the NMOSFET M3. The second terminal of the switch $S_{W13}$ is the source of the NMOSFET M3.

FIG. 6 is an example of an algorithm for determining the maximum power point of the power source according to the present invention.

More precisely, the present algorithm is executed by the processor 300.

The algorithm for obtaining information enabling the determination of the maximum power point of the power source discharges the capacitor $C_{UI}$ in the inductor L1 through interleaved sub-phases of partial charges and discharges prior to the monitoring of the voltage charge of the capacitor $C_{UI}$ in order to get information enabling the determination of the maximum power point of the power source.

At step S600, the phase PH1 starts. The phase PH1 is shown in the FIGS. 7*a* to 7*c*.

FIG. 7*a* is an example of the power source voltage variations obtained according to the present invention.

The time is represented on horizontal axis of the FIG. 7*a* and the voltage is represented on the vertical axis of the FIG. 7*a*.

FIG. 7*b* is an example of power source current variations obtained according to the present invention.

The time is represented on horizontal axis of the FIG. 7*b* and the current is represented on the vertical axis of the FIG. 7*b*.

FIG. 7*c* is an example of the output voltage variations of the energy conversion device according to the present invention.

The time is represented on horizontal axis of the FIG. 7*c* and the voltage is represented on the vertical axis of the FIG. 7*c*.

During the phase PH1, the energy conversion device Conv acts as a boost converter. The NMOSFET M3 and the diode $D_O$ are put in a conductive state and non conductive state according to a periodic pattern of which the duty cycle is adjusted in order to get a desired output voltage. The period of time wherein the command signal of the NMOSFET M3 is high is named D. The period of time wherein the command signal of the NMOSFET M3 is high is named (1−D).

During the phase PH1, the IGBT transistor IG1 is always in conductive state, the NMOSFET M3 is in conductive state during D and the diode $D_O$ is in conductive state during (1−D).

During the phase PH1, the diode D5 is never in conductive state, the NMOSFET M3 is not in conductive state during (1−D) and the diode $D_O$ is not in conductive state during D.

The voltage provided by the power source PV shown in FIG. 7*a* corresponds to a voltage which corresponds to the MPP previously determined by the present algorithm.

The current provided by the power source PV shown in FIG. 7*b* is a current corresponding to the MPP previously determined by the present algorithm.

The voltage $V_{DC}$ at the output shown in FIG. 7*c* is a voltage obtained from the power source PV output voltage and the duty cycle.

The current is provided to the load during the phase PH1.

At next step S601, the processor 300 decides to interrupt the boost conversion mode in order to determine another MPP and moves to a phase PH2.

In phase PH2, the capacitor $C_{UI}$ is discharged through the inductor L1 through interleaved sub-phases of partial charges and discharges as shown in FIG. 7*a*.

In order to avoid that high current flows through L1 and/or $C_{UI}$ the phase PH2 is decomposed into two sub-phases PH2*a* and PH2*b* and a maximum current is set in the sub-phase PH2*a*.

Sub-phase PH2*a* represents the period of time in which the capacitor $C_{UI}$ is partially or completely discharged through the inductor L1.

Sub-phase PH2*b* represents the period of time in which the inductor L1 is partially or completely discharged on a storage device or the load and the capacitor $C_{UI}$ is partially charged by the power source.

At next step S602, the processor 300 starts the phase PH2*a*.

In sub-phase PH2*a*, the IGBT transistor IG1 and the NMOSFET M3 are set in the conductive state and the diodes D5 and $D_O$ are in a non conductive state.

During sub-phase PH2*a*, the capacitor $C_{UI}$ transfers its energy into the inductor L1 in a resonant way as it is shown in FIGS. 8*a* and 8*b*.

FIG. 8*a* is an example of variations of the current flowing through the inductor during the capacitor discharging phase, which is composed of several interleaved sub-phases of partial charges and discharges, according to the present invention.

The time is represented on horizontal axis of the FIG. 8*a* and the current is represented on the vertical axis of the FIG. 8*a*.

FIG. 8*b* is an example of variations of the current flowing through the capacitor during the capacitor discharging phase, which is composed of several interleaved sub-phases of partial charges and discharges, according to the present invention.

The time is represented on horizontal axis of the FIG. 8*b* and the current is represented on the vertical axis of the FIG. 8*b*.

At next step S603, the processor 300 checks if the current $I_{L1}$ flowing through the inductor L1 is greater than a first predetermined value Thres1, for example equal to a maximum current of twenty Amps, or if the capacitor $C_{UI}$ is discharged.

The capacitor $C_{UI}$ is considered to be discharged when the voltage V1 is equal to a second predetermined value Thres2, which is for example equal to null value.

If the current $I_{L1}$ flowing through the inductor L1 is lower than or equal to the first predetermined value Thres1 or if the capacitor $C_{UI}$ is not discharged, the processor 300 returns to step S603. Otherwise, the processor 300 moves to step S604.

As it can be seen if FIG. 8*a*, up to time T1, the current $I_{L1}$ going through the inductor L1 reaches the maximum current of 20 Amp several times.

At T2, the capacitor $C_{UI}$ is discharged.

At step S604, the processor 300 starts the sub-phase PH2*b*.

In sub-phase PH2*b*, the IGBT transistor IG1 and the NMOSFET M3 are set in the not conductive state and the diodes D5 and $D_O$ are in a conductive state.

The inductor L1 discharges its energy into the capacitor $C_O$ and also according to a particular feature into the load as it is shown in FIG. 8*a*.

At the same time the capacitor $C_{UI}$ is charged by the power source PV as shown in FIG. 8*b*.

It has to be noted here that the capacitance value of the capacitor $C_O$ is greater than the capacitance value of the capacitor $C_{UI}$, i.e. the inductor L1 discharge happens much faster than the inductor L1 charge meaning that the charge of the capacitor $C_{UI}$ is always much slower than its discharge, i.e. the inductor L1 charge.

At next step S605, the processor 300 checks if the current $I_{L1}$ going through the inductor L1 is smaller than a third predetermined value Thres3, for example equal to null value.

If the current $I_{L1}$ going through the inductor L1 is greater than the third predetermined value Thres3, the processor 300 returns to step S605. Otherwise, the processor 300 moves to step S606.

At next step S606, the processor 300 checks if the voltage V1 is greater than the second predetermined value Thres2, for example equal to null value.

If the voltage V1 is upper than the second predetermined value Thres2, the processor 300 returns to step S603 and executes successively the sub-phases PH2*a* and PH2*b* as far as the voltage V1 is not smaller or equal to the predetermined value Thres2, for example null value.

If the voltage V1 is smaller than or equal to the second predetermined value Thres2, the processor 300 moves to step S607.

At step S607, the processor 300 starts the phase PH3.

In phase PH3, the IGBT transistor IG1 and the NMOSFET M3 are set in the not conductive state and the diodes D5 and $D_O$ are in a non conductive state.

The capacitor $C_{UI}$ is charged from null voltage to open circuit voltage $V_{OC}$ as shown in FIG. 7*a* and the current moves from the short circuit current to null value as shown in FIG. 7*b*.

At next step S608, the processor 300 commands the sampling, at the sampling period Tsamp, of the voltage V1 which corresponds to the voltage on the capacitor $C_{UI}$ or of the power source PV.

At step S609, the processor 300 gets all the samples determined at the previous step and processed according to the algorithm that will be disclosed in reference to the FIG. 9 and forms a curve as the one shown in FIG. 2.

At the same step, the processor 300 determines the MPP thanks to the voltage and current values obtained from the algorithm of FIG. 9 by selecting the maximum power obtained from voltage and current values.

At step S610, the phase PH4 starts. The phase PH4 is shown in the FIGS. 7*a* to 7*c*.

It has to be noted here that the phase PH3 ends after a predetermined time duration or when the voltage derivative dV1/dt is equal to zero, meaning that the open circuit voltage $V_{OC}$ was reached.

During the phase PH4, the energy conversion device acts as a boost converter. The NMOSFET M3 and the diode $D_O$ are put in a conductive state and non conductive state according to a periodic pattern of which the duty cycle is adjusted in order to get a desired output voltage considering the newly determined MPP. During the phase PH4, the IGBT transistor IG1 is in conductive state, the NMOSFET M3 is in conductive state during D and the diode $D_O$ is in conductive state during (1−D).

During the phase PH4, the diode D5 is not in conductive state, the NMOSFET M3 is not in conductive state during (1−D) and the diode $D_O$ is in conductive state during D.

FIG. 9 is an example of an algorithm for determining the current and output voltage pairs of the power source in order to enable the determination of the maximum power point of the power source according to the mode of realisation of the present invention.

More precisely, the present algorithm is executed by the processor 300.

The algorithm for obtaining information enabling the determination of the maximum power point of the power source according to the particular mode of realisation of the present invention uses the voltage V1 in order to determine the current going through the capacitor $C_{UI}$ during phase PH3.

From a general point of view, with the present algorithm, the current for the given sample is determined by multiplying the capacitance value of the capacitor $C_{UI}$ by the voltage derivative of the given sample, the voltage derivative being obtained through a fitted mathematical function, for example a polynomial function with real coefficients in order to filter the sampled voltages.

The fitted mathematical function is obtained by minimizing the sum of the squares of the difference between the measured voltage $y_i$ with i=1 to N at consecutive time samples $x_i$ and mathematical functions $f(x_i)$ in order to obtain a processed voltage for the given time sample. It is done as follows.

Given N samples $(x_1,y_1)$, $(x_2,y_2)$ . . . $(x_N,y_N)$, the required fitted mathematical function can be written, for example, in the form:

$$f(x)=C_1 \cdot f_1(x)+C_2 \cdot f_2(x)+\ldots+C_K \cdot f_K(x)$$

where $f_j(x)$, j=1, 2 . . . K are mathematical functions of x and the $C_j$, j=1, 2 . . . K are constants which are initially unknown.

The sum of the squares of the difference between f(x) and the actual values of y is given by $$E=\sum_{i=1}^{N}[f(x_i)-y_i]^2$$

$$=\sum_{i=1}^{N}[C_1 f_1(x_i)+C_2 f_2(x_i)+\ldots+C_K f_K(x_i)-y_i]^2$$

This error term is minimized by taking the partial first derivative of E with respect to each of constants, $C_j$, j=1, 2, . . . K and putting the result to zero. Thus, a symmetric system of K linear equation is obtained and solved for $C_1, C_2, \ldots, C_K$. This procedure is also known as Least Mean Squares (LMS) algorithm.

Information enabling the determination of the maximum power point are the power-voltage droop characteristics of the power source PV, directly obtained from the current-voltage droop characteristics.

With the voltage samples of V1, a curve is obtained based on the fitting of suitable mathematical functions, for example polynomial functions with real coefficients, in pre-defined windows which will move for each sample. Thus, the voltage is filtered and its derivative can be simultaneously calculated for every central point in the window in a very simple and direct way, resulting in the determination of current without the need of any additional current sensor.

At next step S900, the processor 300 gets the samples obtained during phase PH3. Each sample is a bi-dimensional vector the coefficients of which are the voltage value and time to which voltage has been measured.

At next step S901, the processor 300 determines the size of a moving window. The size of the moving window indicates the number Npt of samples to be used for determining a curve based on the fitting of suitable mathematical functions, for example polynomial functions with real coefficients. The size of the moving window is odd. For example, the size of the moving window is equal to seventy one.

At next step S902, the processor 300 determines the central point Nc of the moving window.

At next step S903, the processor 300 sets the variable i to the value Npt.

At next step S904, the processor 300 sets the variable j to i−Nc+1.

At next step S905, the processor 300 sets the variable k to one.

At next step S906, the processor 300 sets the value of x(k) to the time coefficient of sample j.

At next step S907, the processor 300 sets the value of y(k) to the voltage coefficient of sample j.

At next step S908, the processor 300 increments the variable k by one.

At next step S909, the processor 300 increments the variable j by one.

At next step S910, the processor 300 checks if the variable j is strictly lower than the sum of i and Nc minored by one.

If the variable j is strictly lower than the sum of i and Nc minored by one, the processor 300 returns to step S906. Otherwise, the processor 300 moves to step S911.

At step S911, the processor 300 determines the fitted mathematical function, for example the polynomial function $y(x)=ax^2+bx+c$, using the Least Mean Square algorithm and all the x(k) and y(k) values sampled at steps S906 and S907 until the condition on S910 is reached.

The processor 300 obtains then the a, b and c real coefficients of the second degree polynomial function ($[a,b,c] \in \Re^3$).

At next step S912, the processor 300 evaluates the filtered voltage value and the current according to the following formulas:

$$V_{PV}(\text{time}[i])=a\cdot\text{time}[i]^2+b\cdot\text{time}[i]+c$$

$$I_{CUI}(\text{time}[i])=C_{UI}\cdot(a\cdot\text{time}[i]+b)$$

At next step S913, the processor 300 increments the variable i by one unit.

At next step S914, the processor 300 checks if i is strictly lower than N minored by Nc wherein N is the total number of voltage samples obtained at step S901.

If i is strictly lower than N minored by Nc, the processor 300 returns to step S904. Otherwise, the processor 300 interrupts the present algorithm and returns to step S609 of the algorithm of FIG. 6.

By moving to step S904, the processor 300 will displace the moving window by one sample.

Naturally, many modifications can be made to the embodiments of the invention described above without departing from the scope of the present invention.

The invention claimed is:

1. Apparatus for obtaining information enabling the determination of a maximum power point of a power source, the apparatus comprising:

at least an inductor and a capacitor connected together via a switch, means for monitoring the voltage charge of the capacitor, discharging means including the switch for discharging the capacitor through the inductor prior to the monitoring of the voltage charge of the capacitor, and means for monitoring the current flowing through the inductor and the switch during the discharge of the capacitor by the discharging means, wherein the capacitor is discharged in the inductor by the discharging means as long as the current flowing through the inductor reaches a first predetermined value or as long as the capacitor is not discharged.

2. Apparatus according to claim 1, wherein the apparatus comprises means for discharging the inductor into at least one device once the current flowing through the inductor reaches the first predetermined value or once the capacitor is discharged.

3. Apparatus according to claim 2, wherein the other device is an energy storage device or a load.

4. Apparatus according to claim 1, wherein the apparatus comprises means for obtaining the current outputted by the power source during the monitoring of the voltage charge of the capacitor.

5. Apparatus according to claim 4, wherein the current outputted by the power source is obtained from a current sensor or derived from the voltage values obtained during the monitoring of the voltage charge of the capacitor.

6. Direct current converter comprising the apparatus according to claim 1.

7. Method for obtaining information enabling the determination of a maximum power point of a power source connected to a direct current converter, the direct current converter comprising at least an inductor and a capacitor connected to each other via a switch, the method comprising:

discharging the capacitor through the inductor via the switch, monitoring the voltage charge of the capacitor in order to obtain information enabling the determination of the maximum power point of the power source, monitoring the current flowing through the inductor and the switch during the discharge of the capacitor by the discharging the capacitor, and wherein the capacitor is discharged in the inductor by the discharging as long as the current flowing through the inductor reaches a first predetermined value or as long as the capacitor is not discharged.

8. Method according to claim 7, wherein the method comprises further monitoring the current going through the inductor during the discharge of the capacitor and the capacitor is discharged in the inductor as long as the current going through the inductor reaches a first predetermined value or as long as the capacitor is not discharged.

9. Method according to claim 8, wherein the method comprises further discharging the inductor into at least another device once the current flowing through the inductor reaches the first predetermined value or once the capacitor is discharged.

10. Method according to claim 9, wherein the discharging the capacitor through the inductor and the discharging the inductor are executed iteratively as far as the voltage of the capacitor reaches a second predetermined value.

* * * * *